US009004193B2

(12) United States Patent
Lavrut et al.

(10) Patent No.: US 9,004,193 B2
(45) Date of Patent: Apr. 14, 2015

(54) SENSOR DEPLOYMENT

(75) Inventors: Eric Lavrut, Yokohama (JP); Charles Woodburn, Paris Cedex (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 634 days.

(21) Appl. No.: 12/744,339

(22) PCT Filed: Nov. 19, 2008

(86) PCT No.: PCT/EP2008/009806

§ 371 (c)(1),
(2), (4) Date: Aug. 5, 2010

(87) PCT Pub. No.: WO2009/065579

PCT Pub. Date: May 28, 2009

(65) Prior Publication Data

US 2010/0294480 A1 Nov. 25, 2010

(30) Foreign Application Priority Data

Nov. 23, 2007 (GB) ..... 0722932.1

(51) Int. Cl.

| | |
|---|---|
| ***E21B 47/024*** | (2006.01) |
| ***E21B 7/06*** | (2006.01) |
| ***E21B 41/00*** | (2006.01) |
| ***E21B 47/01*** | (2012.01) |

(52) U.S. Cl.
CPC ..... *E21B 7/06* (2013.01); *E21B 41/0035* (2013.01); *E21B 47/01* (2013.01)

(58) Field of Classification Search
CPC . E21B 7/061; E21B 41/0035; E21B 41/0042; E21B 47/122; E21B 43/103
USPC ..... 175/77, 78, 50, 53, 61, 62, 73
See application file for complete search history.

(56) References Cited

U.S. PATENT DOCUMENTS

| | | | | |
|---|---|---|---|---|
| 4,007,797 | A * | 2/1977 | Jeter | 175/26 |
| 4,601,353 | A | 7/1986 | Schuh et al. | |
| 6,167,968 | B1 | 1/2001 | Cook | |
| 6,234,257 | B1 * | 5/2001 | Ciglenec et al. | 175/50 |
| 2004/0069487 | A1 | 4/2004 | Cook | |
| 2004/0124994 | A1 * | 7/2004 | Oppelt | 340/853.1 |
| 2005/0252688 | A1 * | 11/2005 | Head et al. | 175/61 |

FOREIGN PATENT DOCUMENTS

| | | |
|---|---|---|
| EP | 1559864 | 6/2006 |
| EP | 1764475 | 3/2007 |
| GB | 2416550 | 2/2006 |
| WO | 2004011766 | 2/2004 |

* cited by examiner

*Primary Examiner* — Shane Bomar
*Assistant Examiner* — Kipp Wallace
(74) *Attorney, Agent, or Firm* — Stephanie Chi; Jody DeStefanis

(57) ABSTRACT

Apparatus and the methods for deploying a sensor in the formation down a borehole. The apparatus comprises a downhole drilling system which is connected at a first end to the surface and is connected at a second end to a flexible drilling string downhole in the borehole. At least a portion of the flexible drilling string is locatable in a lateral hole of the borehole, and at least one downhole sensor is connectable to the portion of the drilling string that is locatable in the lateral hole.

20 Claims, 4 Drawing Sheets

SENSOR DEPLOYMENT

CROSS-REFERENCE TO RELATED APPLICATIONS

The present application is based on and claims priority to GB Application No. 0722932.1, filed 23 Nov. 2007; and International Patent Application No. PCT/EP2008/009806, filed 19 Nov. 2008. The entire contents of each are herein incorporated by reference.

TECHNICAL FIELD

This invention relates to apparatus and a method for deploying a sensor in the formation down a borehole. More particularly, the invention relates to apparatus and a method for deploying a sensor in the formation down a borehole in an oil or gas well.

BACKGROUND ART

Conventionally, well operation and production involves continuous monitoring of various subsurface formation parameters. Continuous monitoring of parameters such as, for example, reservoir pressure and permeability indicate the formation pressure change over a period of time. It is essential to predict the production capacity and lifetime of a subsurface formation. These parameters have generally been obtained during these operations either through wireline logging, drill stem tests or logging while drilling.

With the increase in the importance of production optimization in order to get more oil from depleted reservoirs, newly drilled wells, deep wells, wells having more complex trajectories and wells that are located in more challenging environments, long term monitoring of wells has become even more desirable. In order to achieve this, it is proposed to locate sensors in the formation, possibly buried some distance in the formation around the borehole outside the casing or tubing in the borehole, or in the formation prior to the installation of the casing or the tubing.

It is an object of the invention to provide a technique that allows sensors to be positioned outside the casing or very deep, such as 100, foot in the formation while still allowing communication without the problems of the previous techniques.

An example of one of these difficulties has been in communicating with the sensor through the casing or tubing and deep below the surface, and in providing electrical power to these sensors. The current invention has the advantage that the sensors are capable of communication through the casing or tubing and at high depths, and that they can be electrically powered.

DISCLOSURE OF INVENTION

A first aspect of the invention provides apparatus for deploying a sensor in the formation down a borehole: a downhole drilling system which is connected at its one end to the surface and is connected at its other end to a flexible drilling string downhole in the borehole; at least a portion of the flexible drilling string being locatable in a lateral hole of the borehole; and at least one downhole sensor being connectable to the portion of the drilling string that is locatable in the lateral hole.

In one form of the invention the flexible drilling string may have been used to drill the lateral hole. For this purpose the flexible drilling string may have a drill bit at its end locatable in the lateral hole. In another form of the invention the drilling system is locatable in the lateral hole after it has been drilled.

The sensor may be able to communicate with the drilling apparatus. The sensor may also be able to communicate with the surface.

Preferably, the sensor may be able to be interrogated through the casing. In this case a time lapse survey may be undertaken.

Further according to the invention there may be a plurality of downhole sensors connectable to the portion of the drilling string that is locatable in the lateral hole.

In one form of the invention where there are a plurality of sensors, the sensors may be electrically connected to each other.

In another form of the invention where there are a plurality of sensors, the sensors may be able to communicate via wireless technology. In this form the sensors may be able to communicate with each other via wireless technology. The sensors may be able to communicate with the drilling system and the surface via wireless technology.

The sensors are preferably based on MEMS technology.

A second aspect of the invention provides a method for deploying a sensor in the formation down a borehole, the method comprising:

- connecting one end of a drilling system to the surface and the other end to a flexible drilling string, the flexible drilling string having at least one sensor attached;
- deploying the drilling system downhole in a borehole;
- drilling a lateral hole in the borehole by means of the flexible drilling string; and
- abandoning at least a portion of the flexible drilling string in the lateral hole after it has been drilled, the portion including the at least one downhole sensor.

A third aspect of the invention provides a method for deploying a sensor in the formation down a borehole, the method comprising:

- connecting one end of a drilling system to the surface and the other end to a flexible drilling string, the flexible drilling string having at least one sensor attached;
- deploying the drilling system downhole in a borehole;
- drilling a lateral hole in the borehole; and
- locating at least a portion of the flexible drilling string in the lateral hole, the portion including the at least one downhole sensor.

The method may further include abandoning the portion of the drilling string that was located in the lateral hole and leaving in the lateral hole as a measurement string.

There may be a plurality of downhole sensors connectable to the portion of the drilling string that was located in the lateral hole.

Preferably, the sensors may be able to communicate with the drilling system, and preferably the sensors may be able to communicate with the surface.

The sensors may be electrically connected to each other. The sensors may be able to communicate via wireless technology. In this way the sensors may be able to communicate with each other via wireless technology.

BRIEF DESCRIPTION OF FIGURES IN THE DRAWINGS

MODE(S) FOR CARRYING OUT THE INVENTION

Figure 1:
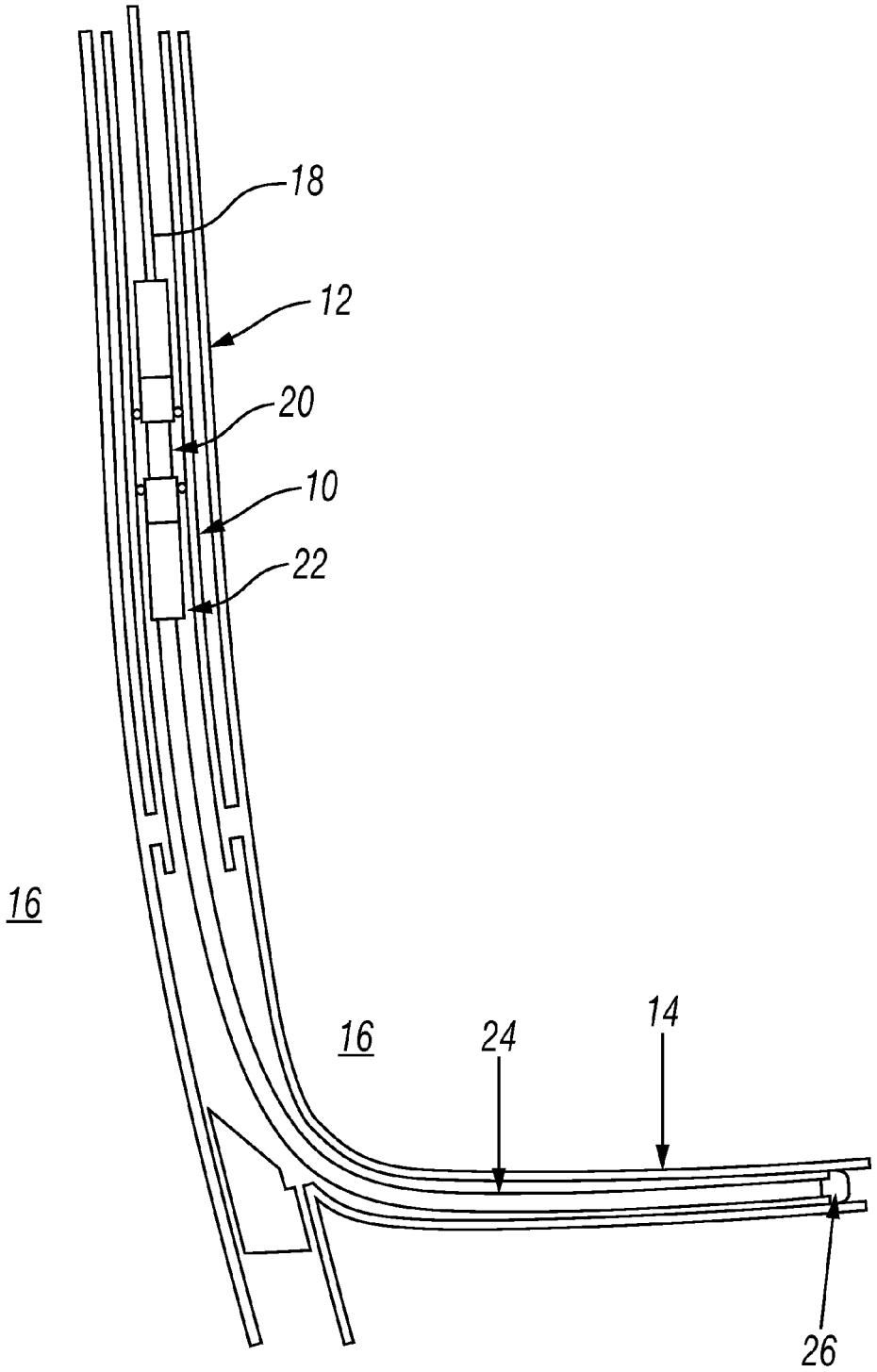
FIG. 1 shows a schematic side view of a first embodiment of an apparatus for deploying a sensor in the formation down a borehole, according to the invention.

Various preferred embodiments of the invention are shown in FIGS. 1 to 4, in which apparatus 10 for deploying a sensor (not shown) in the formation down a borehole 12 and into a lateral hole 14 in the formation 16 surrounding the borehole 12 is shown. In FIG. 1 apparatus 10 is shown to include a drilling system which has a wireline cable 18, a tractor 20 and drilling motor 22. A flexible drilling string 24, having a drill bit 26 at its drilling end is connected to the drilling system. Drill bit 26 is used for short radius lateral drilling and allows small lateral holes to be drilled from a parent borehole in a well, such as an oil or gas well. The length of the lateral hole 14 varies from a few inches, which is enough for setting a single sensor, to a few hundred feet, which allows installing a full array of sensors far in the formation 16. The sensors are highly integrated sensors, preferably based on MEMS (Micro-Electro-Mechanical Systems) technology.

The sensors may be used to measure and monitor parameters such as, for example, density, viscosity, pressure, temperature, resistance, permeability or seismic measurements.

The drilling motor used in the embodiment shown in FIG. 1 is too big for the lateral hole 14 and remains in the parent borehole 12, which may have production tubing, casing or it may be an open hole. The drilling efforts, such as, weight on bit and torque on bit, are typically transmitted to the drill bit 26 by the way of the flexible drilling string 24.

Figure 2:
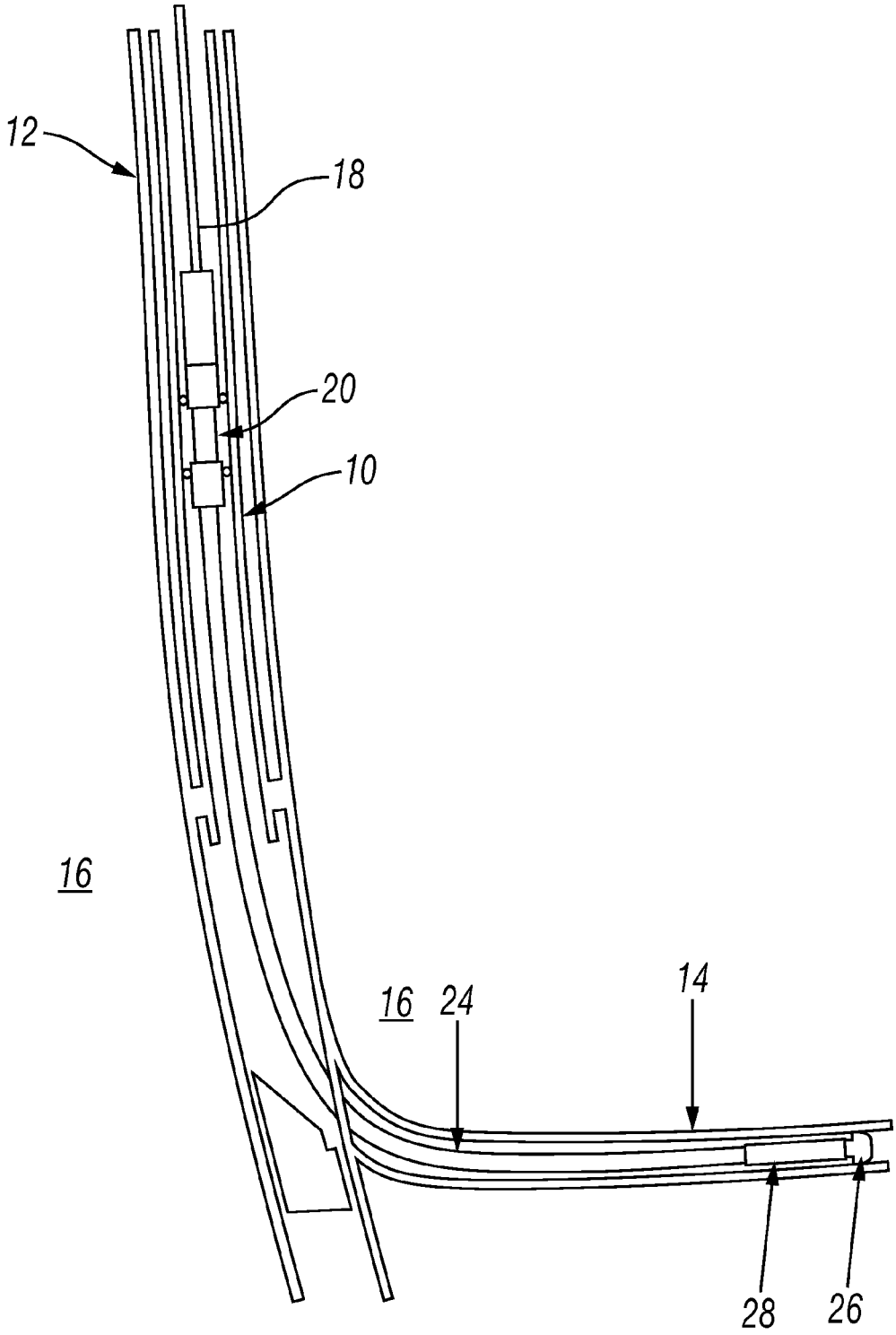
FIG. 2 shows a second embodiment of an apparatus for deploying a sensor in the formation down a borehole, according to the invention.

In the second embodiment of the invention as shown in FIG. 2, apparatus 10 is shown to include a drilling system which has a wireline cable 18 and a tractor 20. A flexible drilling string 24, having a small drilling motor 28 and a drill bit 26 at its drilling end, is connected to the drilling system. In this embodiment, the torque on bit is generated by the small drilling motor 28 behind the drill bit 26. The flexible drilling string 24 does not rotate in this embodiment.

Figure 3:
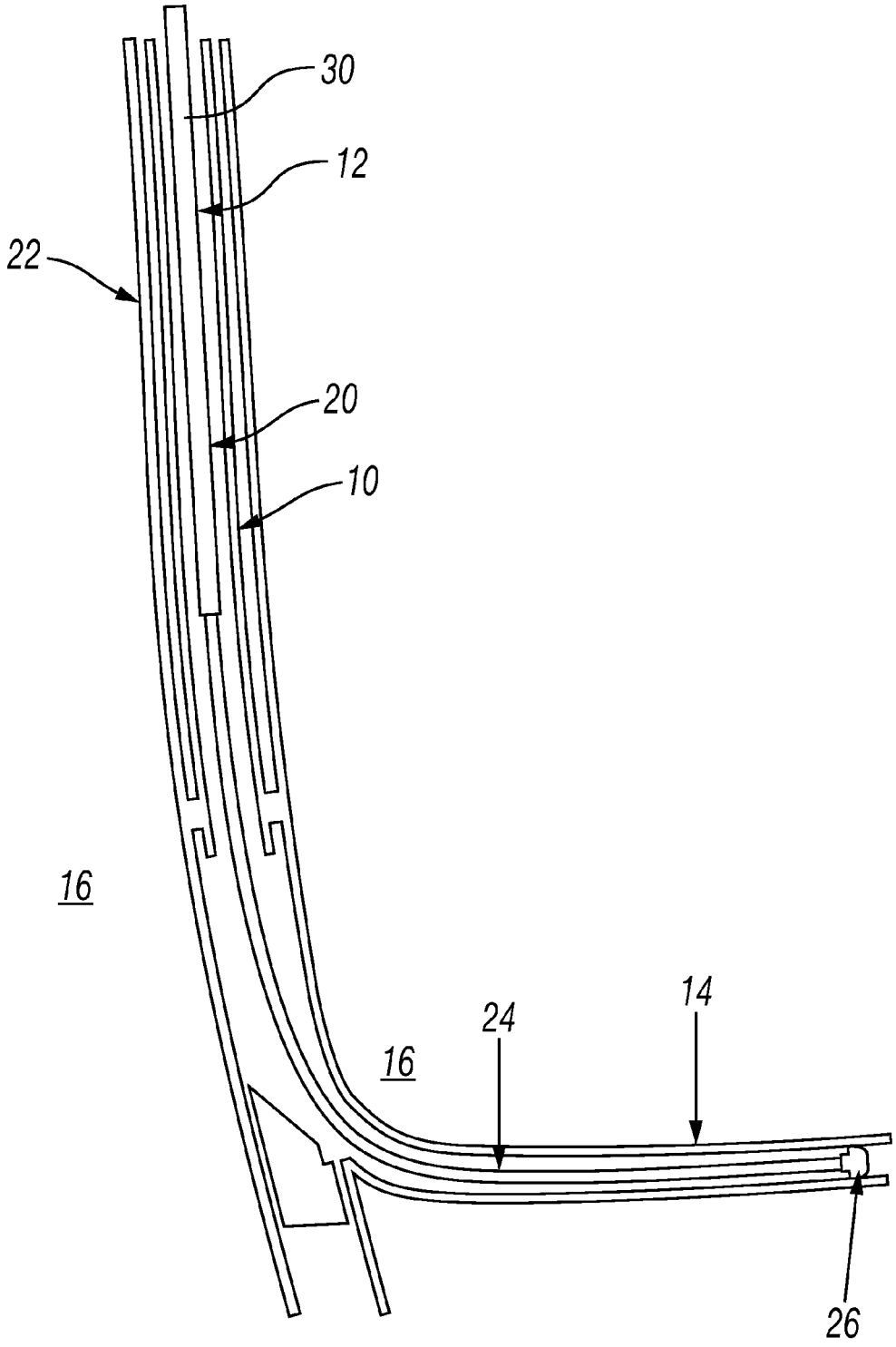
FIG. 3 shows a third embodiment of an apparatus for deploying a sensor in the formation down a borehole, according to the invention.

In the third embodiment of the invention as shown in FIG. 3, apparatus 10 is shown to include a drilling system which has drill pipes, or coil tubing 30, a tractor 20 and drilling motor 22. A flexible drilling string 24, having a drill bit 26 at its drilling end is connected to the drilling system. The drilling system shown in FIG. 3 uses a conventional drilling technology having coil tubing or drill pipes. The portion of the flexible drilling string 24 that is located in the lateral hole 14 is more flexible than that which is used in the first and second embodiments of the invention in order to drill the lateral hole 14.

In the embodiments of the invention as shown in FIGS. 1, 2 and 3, the "while drilling" concept of the invention is illustrated. In the "while drilling" concept, the sensors are mounted on the flexible drilling string 24. Once the lateral hole 14 is drilled, the flexible drill string 24 and the drill bit 26 are abandoned in the lateral and they then serve as a measurement string.

This method of deploying the sensors in the lateral hole 14 thus does not require an additional run to install the sensors. The drilling string 24 having the sensors already connected can also be used as a "measurement while drilling" tool.

Figure 4:
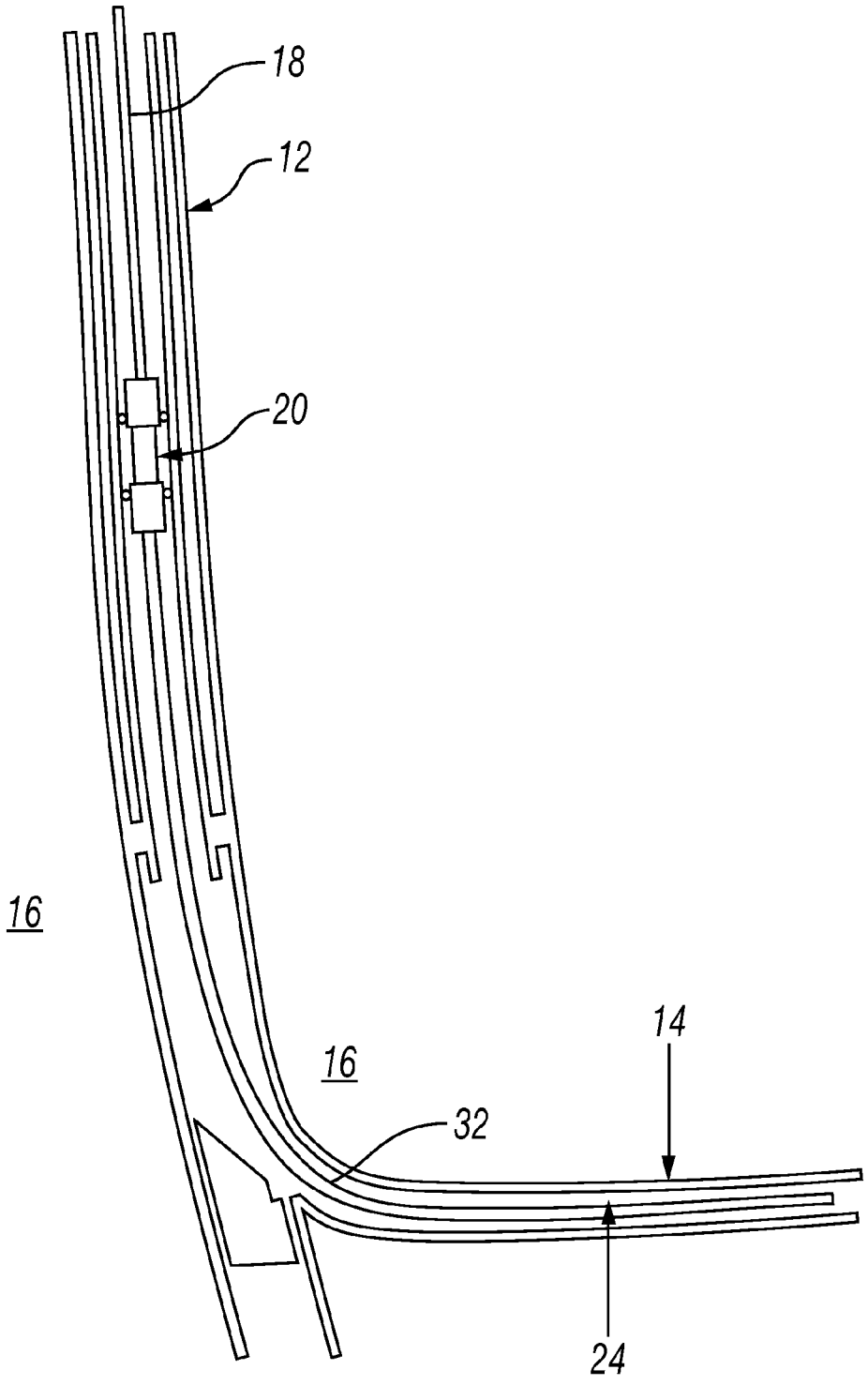
FIG. 4 shows a fourth embodiment of an apparatus for deploying a sensor in the formation down a borehole, according to the invention.

In the fourth embodiment of the invention as shown in FIG. 4, the drilling system is shown to include a wireline cable 18 and a tractor 20, but it could also have drill pipes, or coil tubing 30 and a tractor 20. In this embodiment, known as the "after drilling" concept, the sensors are deployed into an existing lateral hole 14 which has been previously drilled. The drilling string 24 has the sensors already connected and is deposited into lateral hole 14 by means of a tractor 20, coil tubing 30 or drill pipes. Drilling string 24 does not need to withstand the drilling efforts and the drilling environment.

The sensors may also be in the form of one or more sensor plugs attached to the drilling string 24. The drilling string 24 may also additionally have an antennae 32 (as indicated in FIG. 4) attached thereto for receiving and transmitting data from the sensors to the drilling apparatus and/or the surface.

This drilling string having the sensors already connected may provide sensors mounting features and some form of electrical connection between the sensors.

A sensor that is used according to the invention can comprise a sensing device with its associated electronics including circuits such as converters, amplifiers, battery and microcontroller and connected to an antenna for communication link and powering.

The sensors may have electrical connectivity with each other and with the drilling system. The sensors may also include wireless technology, such as EMAG of RF, and have the capability of wireless communication. Through this they may be in communication with each other, and with the drilling system and the surface from downhole in the well.

The sensors can therefore be interrogated through the casing in the well, for time-lapse surveys.

While the present invention has been described with respect to a limited number of embodiments, those skilled in the art having the benefit of this disclosure, will appreciate numerous modifications and variations therefrom. It is intended that the appended claims cover all such modifications and variations as fall within the true spirit and scope of this present invention.

What is claimed is:

1. Apparatus for deploying a sensor in the formation down a borehole:

a downhole drilling system connected at a first end at the surface and connected at a second end to a flexible drilling string downhole, wherein at least a portion of the flexible drilling string is configured to be disposed in a lateral hole of the borehole and configured to be disconnected from the downhole drilling system; and at least one downhole sensor connected to the portion of the flexible drilling string that is located in the lateral hole, wherein the at least one downhole sensor is configured to communicate measurements to the surface after the flexible drilling string is disconnected from the downhole drilling system in the lateral hole wherein the flexible drilling string is used to drill the lateral hole.

2. Apparatus as claimed in claim 1, wherein the flexible drilling string includes a drill bit at an end locatable in the lateral hole.

3. Apparatus as claimed in claim 1, wherein the drilling system is locatable in the lateral hole after it has been drilled.

4. Apparatus as claimed in claim 1, wherein the sensor is adapted to communicate with the drilling apparatus.

5. Apparatus as claimed in claim 1, wherein the sensor is adapted to communicate with the surface.

6. Apparatus as claimed in claim 1, wherein the sensor is adapted to be interrogated through the casing.

7. Apparatus as claimed in claim 6, wherein a time lapse survey may be undertaken.

8. Apparatus as claimed in claim 1, wherein there are a plurality of downhole sensors connectable to the portion of the drilling string that is locatable in the lateral hole.

9. Apparatus as claimed in claim 8, wherein the sensors are electrically connected to each other.

10. Apparatus as claimed in claim 8, wherein the sensors are able to communicate via wireless technology.

11. Apparatus as claimed in claim 8, wherein the sensors are able to communicate with each other via wireless technology.

12. Apparatus as claimed in claim 8, wherein the sensors are able to communicate with the drilling system and the surface via wireless technology.

13. Apparatus as claimed in claim 1, wherein the sensors are based on MEMS technology.

14. A method for deploying a sensor in the formation down a borehole, the method comprising:

connecting a first end of a drilling system at the surface and a second end to a flexible drilling string, the flexible drilling string having at least one sensor attached;

deploying the drilling system downhole in a borehole;

drilling a lateral hole in the borehole by means of the flexible drilling string;

abandoning at least a portion of the flexible drilling string in the lateral hole after it has been drilled, the portion abandoned in the lateral hole including the at least one downhole sensor; and receiving measurements from the at least one downhole sensor after the portion of the flexible drilling string has been abandoned in the lateral hole.

15. A method for deploying a sensor in the formation down a borehole, the method comprising:

connecting a first end of a drilling system at the surface and a second end to a flexible drilling string, the flexible drilling string having at least one sensor attached;

deploying the drilling system downhole in a borehole;

drilling a lateral hole in the borehole by means of the flexible drilling string;

locating at least a portion of the flexible drilling string in the lateral hole, the portion including the at least one downhole sensor;

abandoning the portion of the flexible drilling string in the lateral hole; and operating the at least one downhole sensor in the lateral hole, after the portion of the flexible drilling string has been abandoned in the lateral hole.

16. The method as claimed in claims 15, wherein a plurality of downhole sensors are connectable to the portion of the drilling string that was located in the lateral hole.

17. The method as claimed in claim 16, wherein the sensors are able to communicate with the drilling system.

18. The method as claimed in claim 16, wherein the sensors are able to communicate with the surface.

19. The method as claimed in claim 15, wherein the sensors are electrically connected to each other.

20. The method as claimed in claim 15, wherein the sensors are able to communicate via wireless technology.

* * * * *